United States Patent [19]

Antonious

[11] Patent Number: 4,747,599

[45] Date of Patent: May 31, 1988

[54] GOLF CLUB PUTTER

[76] Inventor: Anthony J. Antonious, 205 E. Joppa Rd., Towson, Md. 21204

[21] Appl. No.: 853,123

[22] Filed: Apr. 17, 1986

[51] Int. Cl.[4] ..... A63B 53/02; A63B 53/04

[52] U.S. Cl. ..... 273/167 G; 273/80.2; 273/169; 273/164

[58] Field of Search ..... 273/164, 171, 172, 80.2, 273/80.3, 80.4, 80.5, 80.6, 80.7, 80.8, 80.9, 167 F, 169, 163, 173, 167 R, 167 G, 174; D 21/217, 218, 219

[56] References Cited

U.S. PATENT DOCUMENTS

| | | | |
|---|---|---|---|
| D 185,612 | 6/1959 | Phillips | D 21/219 |
| D 240,445 | 7/1976 | Berker | D 21/219 |
| 1,652,404 | 12/1927 | Graveure | 273/164 |
| 3,037,770 | 6/1962 | Palmer | 273/164 X |
| 3,448,981 | 6/1969 | Anweiler | 273/164 X |
| 3,595,577 | 7/1971 | Hodge | 273/167 F |
| 4,240,636 | 12/1980 | Swenson | 273/164 X |

*Primary Examiner*—George J. Marlo
*Attorney, Agent, or Firm*—N. J. Aquilino

[57] ABSTRACT

A putter type golf club head including a club head body with a ball striking face and a triangular hosel having an upright side, a base at 90 degrees to the upright side and a hypotenuse side. The apex of triangular hosel is connected to a shaft socket and the base is connected to the club head body. The base extends from a point adjacent the ball striking face rearwardly to a second point adjacent the rear of the club head and is in a plane perpendicular to the ball striking face. The club head includes a lower flange extending rearward from the striking face. An upright boss is provided on the flange adjacent the heel and the toe ends of the club.

6 Claims, 3 Drawing Sheets

GOLF CLUB PUTTER

BACKGROUND OF THE INVENTION

The present invention relates to golf club heads, and more particularly to an improved putter type golf club head configuration having a unique hosel structure.

It has long been recognized that a golf ball struck by a club head at a point other than the center of percussion will create a turning moment force causing the club head to rotate about the center of percussion. This rotation causes the ball to deviate from its intended path when all other outside influences, such as the nature and texture of the putting surface, are equal. Various successful attempts have been made to minimize the tendency of the club head to rotate using weighting designs which increase the polar moment of inertia making it more difficult for the club head to rotate for a given amount of applied force. Typical of such golf clubs are heel-toe weighted clubs and other clubs using similar weighting techniques.

The present invention provides a golf club head having a novel hosel structure which provides more stability and decreases the tendency of the golf club head to rotate when a ball is struck off of the center of percussion on the club head.

The club head is provided with a triangular hosel with its base connected to the club head body between a point adjacent the rear edge of the club head and a point adjacent the ball striking face. The triangular hosel includes a 90 degree upright side extending above the ball striking face and connecting the club head body to the shaft socket and a hypotenuse side extending above the ball striking face and connecting the base and the upright side. The triangular hosel is formed in a plane which is perpendicular to the ball striking face of the club head. The triangular hosel provides additional support and helps to brace the putter head to resist opposing torquing forces created by off-center impacts of a golf ball as it is struck toward its intended target.

DESCRIPTION OF THE PREFERRED EMBODIMENTS

Figure 1:
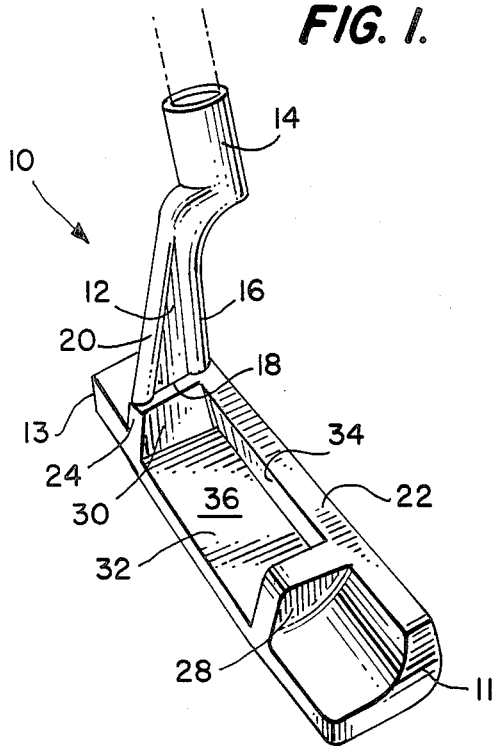
FIG. 1 is a rear perspective view of a golf club head in accordance with the present invention.
Figure 2:
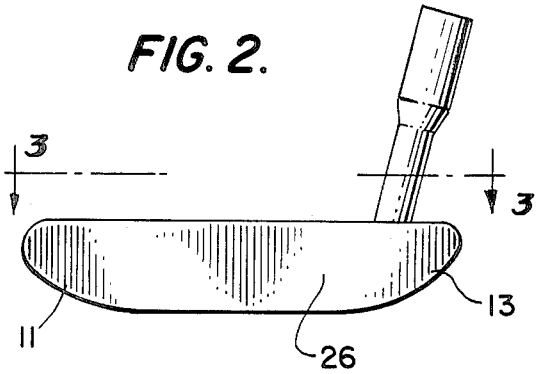
FIG. 2 is a front elevational view of the club head of FIG. 1.
Figure 3:
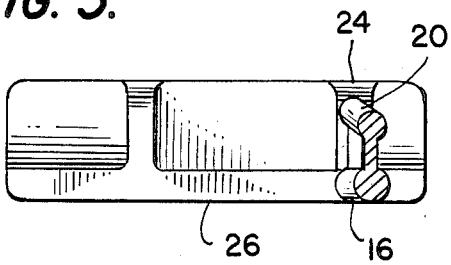
FIG. 3 is a plan view of the club head of FIG. 1, partially in section, taken along the line 3—3 of FIG. 2.

FIGS. 1, 2 and 3 illustrate one embodiment of a golf club head 10 of the present invention employing a triangular hosel 12. The apex of the triangular hosel 12 is connected to the bottom of a shaft socket 14 which is adapted to receive a suitable golf club shaft, shown in phantom in the figures. The triangular hosel includes an upright side 16, a base 18 and a hypotenuse side 20. The base of the triangular hosel 12 is connected to a club head body 22 and extends from a point adjacent the rear edge 24 of the club head 10 to a point adjacent the ball striking face 26. As shown in FIG. 3, the upright side 16 and the hyptoenuse side 20 are thicker in cross section than the inner plate connecting them.

The upright side 16 extends above the ball striking face 26 from a point adjacent to the ball striking face 26 to a point adjacent the bottom of the shaft socket 14. The hypotenuse side 20 also extends above the ball striking face 26 from a point adjacent the rear edge 24 of the club head to a point adjacent the bottom of the shaft socket 14. The body of the golf club head 10 includes a toe section, and a heel section 13. The toe section includes an upright boss member 28 and the heel section includes an upright boss member 30. Each of the boss members 28 and 30 are integrally formed with rear wall 34 behind the ball striking face 26 and the upper surface of the rearwardly extending flange 32. A cavity 36 is formed in the body of the club head 10 defined by the upright boss members 28 and 30, the rear wall 34 and the upper surface of the rearwardly extending flange 32. The base 18 of the triangular hosel 12 is positioned on the upper surface of the upright boss member 30 formed adjacent the heel section 13. With this structural arrangement, the hosel member forms a one-piece, in-line connection between the shaft socket and the upper surface of the rearwardly extending flange 32.

This preferred design provides the necessary strength while conserving material cost and regulating the weight of the club head 10. The triangular hosel 12 lies in a plane which is perpendicular to the ball striking face 26, as shown in the partial sectional view of FIG. 3. In the embodiment shown, the socket 14 is offset in a forward direction in order to be in front of the ball striking face 26.

The structural arrangement of the club head 10, wherein the base 18 of the triangular hosel 12 extends essentially the entire width of the club head 22, provides a solid connection between the shaft and the club head 10 thereby adding strength and stability to the club. A ball striking force is transmitted from the shaft in a direction that is essentially parallel to the plane through the triangular hosel 12 and parallel to the intended line upon which the ball is to be struck. The triangular hosel 12 extends the entire width of the club head 10 and aids in eliminating the tendency of the club head to rotate when the golf ball is struck at a point other than the center of percussion.

Figure 4:
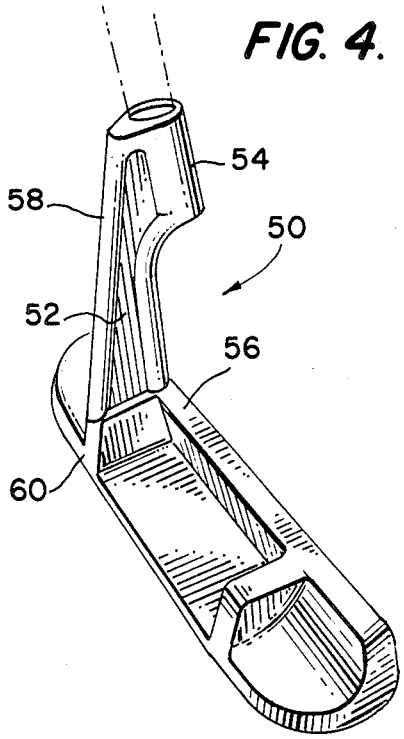
FIG. 4 is a rear prospective view of a second embodiment of the present invention.

FIG. 4 illustrates another embodiment of the present invention. A club head 50 includes a triangular hosel 52, a shaft socket 54 and a club head body 56. The triangular hosel 52 is perpendicular to the ball striking face (not shown) of the club head 50 which aids in the transfer of the forces from the shaft through the club head. In this embodiment the hypotenuse side 58 of the triangular hosel extends above the ball striking face from the rear edge 60 of the club head 50 and terminates at the apex point at the top of the shaft socket 54.

Figure 5:
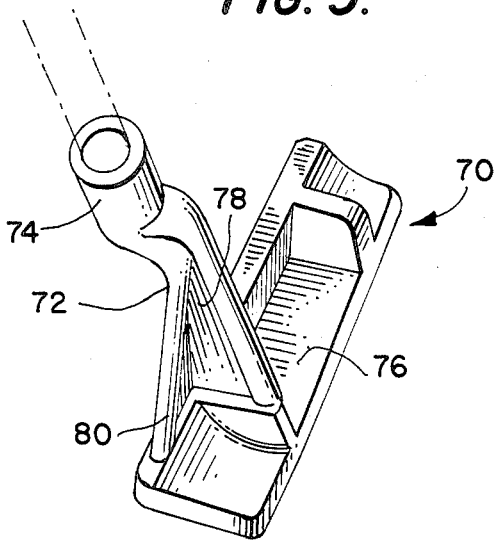
FIG. 5 is a rear perspective view of a third embodiment of the present invention.
Figure 6:
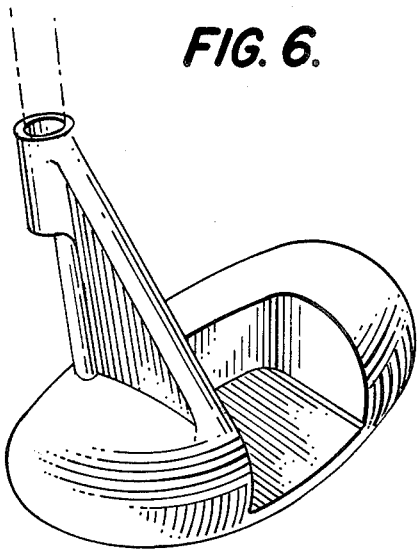
FIG. 6 is a rear perspective view of a fourth embodiment of the present invention.
Figure 7:
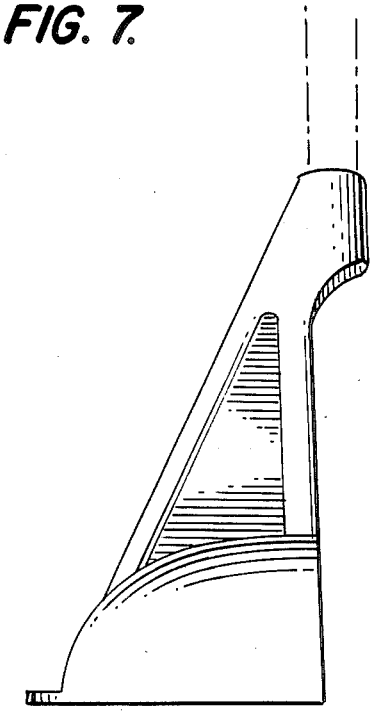
FIG. 7 is a side elevational view of the club head of FIG. 6.
Figure 8:
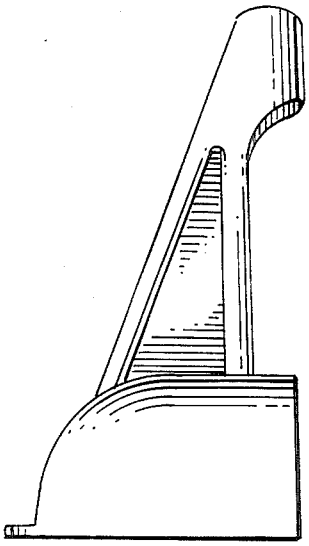
FIG. 8 is a side elevational view of a fifth embodiment of the present invention.
Figure 9:
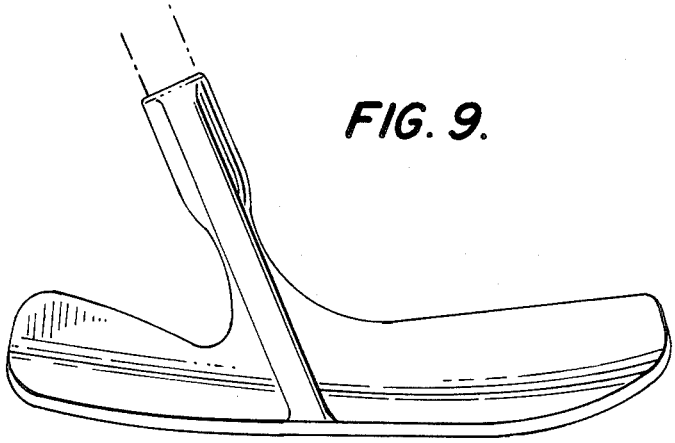
FIG. 9 is a rear view of a sixth embodiment of the present invention.

FIG. 5 illustrates an embodiment of the present invention wherein a club head 70 includes a dual triangular hosel 72, a shaft socket and a dual head body 76. The dual triangular hosel 72 is formed of a first triangular plate 78, which is perpendicular to the ball striking face (not shown), and a second triangular plate 80 which is parallel to the ball striking face. The first triangular plate 78 is similar in structure and purpose to the triangular plates previously discussed and shown in FIGS. 1–4. The second triangular plate 80 consists of a right angle triangle including a base attached to the club head, a hyptoenuse extending from the club head to the hosel stem, and an upright side which is common to the upright side of triangular plate 78. This plate provides increased stability to the club and can be added to either side of the triangular plate 78, depending upon the club head design.

Figure 13:
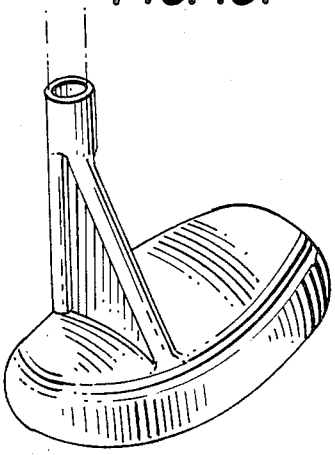
FIG. 13 is a rear perspective view of an eighth embodiment of the present invention.
Figure 14:
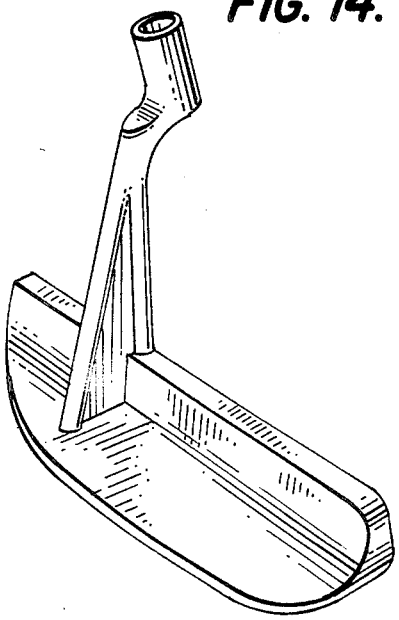
FIG. 14 is a rear perspective view of a ninth embodiment of the present invention.
Figure 15:
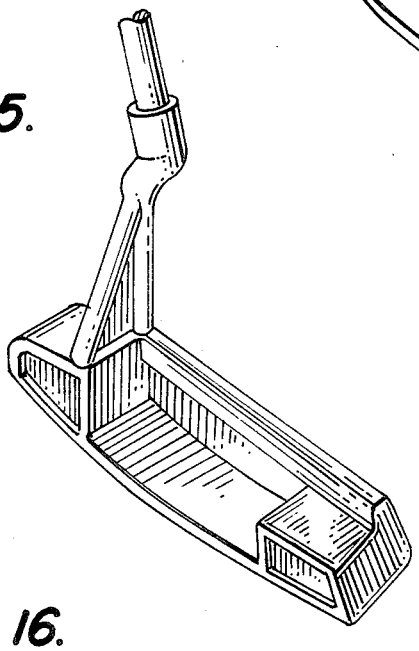
FIG. 15 is a rear perspective view of a tenth embodiment of the present invention.
Figure 16:
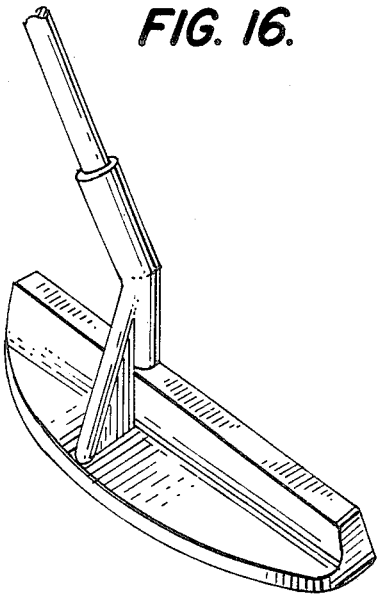
FIG. 16 is a rear perspective view of an eleventh embodiment of the present invention.

FIGS. 6 through 11 and 14, 15 and 16 illustrate various other embodiments of golf club heads using the novel hosel structure of the present invention in a variety of putter type golf club heads, wherein a hosel stem is triangular and is located between and connecting the club head body and the shaft socket in a plane perpendicular to the ball striking face. In all these embodiment, the structure is essentially the same as described hereinabove with respect to the embodiment of FIGS. 1 through 3. In each of the embodiments of FIGS. 6 through 11 and 14, 15 and 16, a central plate interconnects the base, which may be formed by the upper surface of he club head body, the upright side and the hypotenuse side of the triangular hosel. In FIG. 13, no plate interconnects the upright side and the hypotenuse side of the hosel forming a bifurcated structure which is open in the center.

Figure 12:
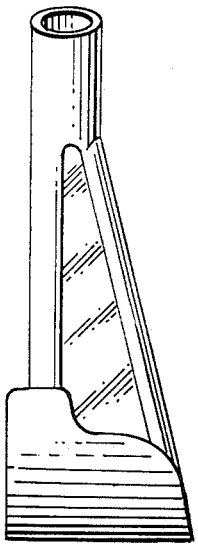
FIG. 12 is a side elevational view of a seventh embodiment of the present invention.
Figure 10:
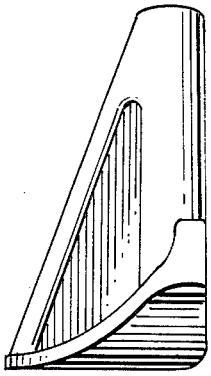
FIG. 10 is a side elevational view of the golf club head of FIG. 9.
Figure 11:
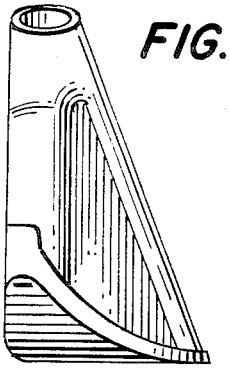
FIG. 11 is a side elevational view of a golf club head of FIG. 9 taken from the opposite of FIG. 10.

FIG. 12 shows a club head wherein the central plate connecting the base side and hypotenuse is made of a solid, clear material such as glass or plastic.

Figure 17:
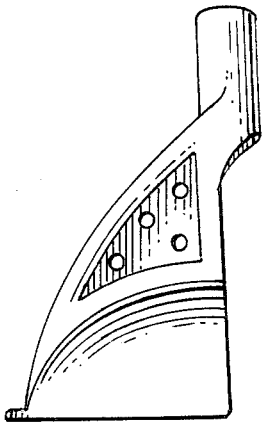
FIG. 17 is a side elevational view of a twelfth embodiment of the present invention.

FIG. 17 shows a club head wherein the central plate is formed of a plurality of openings as shown. The design of the openings may take various shapes including perforations, holes, webs, lattices, meshes or other nonsolid structures.

It will be appreciated that modification may be provided in keeping within the scope of the present invention as defined in the following claims.

I claim:

1. A putter-type golf club head comprising:

a shaft socket structured to receive a golf club shaft;

a club head body including a heel end, toe end, ball striking face, a rear wall behind said ball striking face, a rearwardly extending lower flange having an upper surface thereon, a pair of upright boss members located on said upper surface of said rearwardly extending lower flange and connected to said rear wall behind said ball striking face, one of said boss members being located inward of but adjacent said heel end and a second of said boss members being located inward of but adjacent said toe end;

a cavity defined by said read wall, said upper surface of said rearwardly extending lower flange and said upright boss members;

a hosel member defined by a triangular shape including an upright side adjacent to and extending above said ball striking face to said shaft socket, a base 90 degrees to said upright side, said base extending from adjacent said ball striking face rearwardly to adjacent said rear edge, and being located on said boss member adjacent said heel end, said hosel member having a hypotenuse side connecting said upright side and said base, said hypotenuse side extending above said ball striking face from adjacent said shaft socket to adjacent said rear edge;

said hosel member being located in a plane perpendicular to said ball striking face and forming a one-piece, in-line connection between said shaft socket and said rearwardly extending lower flange.

2. The putter-type golf club head of claim 1 further characterized by hosel member including a centrally located, solid plate member at least a portion of which is planar in shape and located between said upright side, said base and said hypotenuse side.

3. The golf club head of claim 1 wherein said shaft socket is offset in front of said ball striking face.

4. The golf club head of claim 1 wherein said apex of said triangular hosel terminates adjacent the lower edge of said shaft socket.

5. The golf club head of claim 1 wherein said apex of said triangular hosel terminates adjacent the upper edge of said shaft socket.

6. The golf club head of claim 1 wherein said shaft socket is in line with said ball striking face.

* * * * *